US009963335B2

(12) United States Patent
Clüsserath

(10) Patent No.: US 9,963,335 B2
(45) Date of Patent: May 8, 2018

(54) METHOD AND SYSTEM FOR FILLING CONTAINERS

(71) Applicant: KHS GmbH, Dortmund (DE)

(72) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 197 days.

(21) Appl. No.: 14/782,391

(22) PCT Filed: Mar. 11, 2014

(86) PCT No.: PCT/EP2014/000641
§ 371 (c)(1),
(2) Date: Oct. 5, 2015

(87) PCT Pub. No.: WO2014/161628
PCT Pub. Date: Oct. 9, 2014

(65) Prior Publication Data

US 2016/0052765 A1 Feb. 25, 2016

(30) Foreign Application Priority Data

Apr. 5, 2013 (DE) ..... 10 2013 103 431

(51) Int. Cl.

| | |
|---|---|
| ***B65B 1/04*** | (2006.01) |
| ***B67C 3/06*** | (2006.01) |
| ***B67C 3/00*** | (2006.01) |
| ***B67C 3/26*** | (2006.01) |
| ***B67C 3/28*** | (2006.01) |

(52) U.S. Cl.
CPC ..... *B67C 3/06* (2013.01); *B67C 3/007* (2013.01); *B67C 3/262* (2013.01); *B67C 3/286* (2013.01)

(58) Field of Classification Search
CPC ..... B67C 3/06; B67C 3/286; B67C 3/007; B67C 3/262
See application file for complete search history.

(56) References Cited

U.S. PATENT DOCUMENTS

2002/0139434 A1 10/2002 Meheen

FOREIGN PATENT DOCUMENTS

| | | |
|---|---|---|
| DE | 39 30 593 | 3/1991 |
| DE | 41 34 446 | 4/1993 |
| DE | 42 39 238 | 5/1994 |
| DE | 10 2007 058 047 | 6/2009 |
| DE | 10 2009 016 322 | 10/2010 |
| EP | 1 162 167 | 12/2001 |
| WO | WO2005/056464 | 6/2005 |
| WO | WO2010/131271 | 11/2010 |

*Primary Examiner* — Jason K Niesz
(74) *Attorney, Agent, or Firm* — Occhiuti & Rohlicek LLP

(57) ABSTRACT

A method for filling containers with a liquid filling-medium supplied from a filling-medium tank includes sealing a container against a filling element, connecting an interior of the container to a flow duct within the filling element, adding liquid filling-medium to the container, thereby causing gas to exit the container via the flow duct, using pressurized gas, removing liquid filling-medium from the container through a flow duct, guiding the removed liquid filling-medium to a collection chamber, and monitoring flow of matter that passes through the flow duct on its way to the collection chamber.

8 Claims, 2 Drawing Sheets

METHOD AND SYSTEM FOR FILLING CONTAINERS

RELATED APPLICATIONS

This application is the national stage, under 35 USC 371, of international application PCT/EP2014/000641, filed Mar. 11, 2014, which claims the benefit of the Apr. 5, 2013 priority date of German application DE 102013103431.4, the contents of which are herein incorporated by reference.

FIELD OF INVENTION

The invention relates to filling machines, and in particular, to filling machines that remove liquid filling-material from a container.

BACKGROUND

When pressure-filling a bottle, one typically presses its opening up against a filling element to form a seal. Then, a valve opens to let filling material into the bottle. When enough filling material has entered, the valve closes.

In the process of filling, excess liquid filling medium and gas returns to a main supply tank so that it can be reused to fill other bottles. When this material arrives at the tank, it tends to generates a vortex.

A vortex is associated with a region of locally low pressure. Therefore, when a vortex is near a filling medium that has volatile components, those volatile components will be encouraged to come out of solution. This is a particular problem with products that have a high alcohol content, for example alcohol content greater than 25%. Examples of such filing materials include spirits. In such cases, the vortex promotes alcohol evaporation.

SUMMARY

The object of the invention is to provide a method that enables safe filling and reliable detection of defective filling points during the filling process.

In one aspect, the invention features a method for filling containers with a liquid filling medium supplied from a filling medium tank. Such a method includes sealing a container against a filling element, connecting an interior of the container to a flow duct within the filling element, adding liquid filling material to the container, thereby causing gas to exit the container via the flow duct, using pressurized gas, removing liquid filling medium from the container through a flow duct, guiding the removed liquid filling medium to a collection chamber, and monitoring flow of matter that passes through the flow duct on its way to the collection chamber.

In some practices, forcing liquid filling medium to exit the container via the flow duct and to enter a collection chamber comprises causing the liquid filling medium to enter an interior of a liquid filling medium tank that supplies liquid filling medium to a plurality of filling elements.

Other practices include causing liquid filling medium to flow from the collection chamber to a liquid filling medium tank that supplies liquid filling medium to a plurality of filling elements.

Yet other practices include causing liquid filling medium to flow from the collection chamber to a liquid-filled space of a liquid filling medium tank that supplies liquid filling medium to a plurality of filling elements.

Among other practices are those in which monitoring the flow comprises detecting a flow that is inconsistent with a nominal flow value. These practices include shutting down the filling element in response to detecting the flow.

Practices of the invention also include those in which adding liquid filling material to the container comprises overfilling the container. These practices further include causing excess liquid medium to climb out of the container through the flow duct and past a sensor for monitoring flow of matter that passes through the flow duct on its way to the collection chamber.

In another aspect, the invention comprises a filling system having a tank, a liquid-filled space, a collection chamber, and a filling element. The filling element includes a liquid-carrying channel, a discharge opening, a liquid-dispensing valve, a sensor, and a flow duct. In operation, the tank is partially-filled with the liquid filling medium, thus defining the liquid-filled space within the tank. The liquid-carrying channel forms the discharge opening through which the medium flows into a container that is sealed against the filling element. This flow is controlled by the liquid-dispending valve. The liquid-carrying channel connects to the liquid space. During a filling phase, the flow duct connects to an interior of the container during a filling phase. Return gas displaced from the container during filling flows through the flow duct and enters the collection chamber. The sensor monitors flow of matter through the flow duct.

Some embodiments also include a return-gas tube that, in operation, extends into the container and enables matter from the container to be guided out of the container and into the collection chamber following overfilling of the container past a nominal fill level.

Embodiments include those in which the collection chamber is separate from the tank and also those in which the collection chamber is formed at least in part by the tank's interior.

Also among the embodiments are those in which collection chamber separates the matter into a liquid fraction and a gas fraction. These embodiments include a connection between the collection chamber and the liquid space through which the liquid fraction is returned to the tank.

One particular feature of the method according to the invention and of the filling system according to the invention lies in the fact that the flow of the return gas displaced from the interior of the container during the filling process and/or the flow of the filling medium displaced from the interior of the container, for example, during the filling level correction, is monitored in a flow duct having at least one sensor designed as a flow monitor and/or flow meter, namely in the flow duct via which the return gas and/or the filling medium is returned to a collection chamber. In this way, it is possible to obtain data regarding the leak tightness of the container to be filled and of the system including the container bearing sealingly, and to monitor this.

According to an improved method, the flow duct for returning the return gas and/or the filling medium may be connected for example to the interior of the filling medium tank or else to the interior of a separate collection chamber, from which the filling medium collecting therein is then preferably fed back into the filling medium tank or into a liquid space of the filling medium tank. In the case of liquids that give off a lot of gases, this return preferably takes place at the bottom, at a region below the filling-medium level in the filling medium tank, so that a disturbance of the liquid space by returned filling medium is avoided or substantially avoided. As a result, even a bottling of filling medium containing volatile components such as alcohol or flavorings is possible without any problem. In the case of liquids that do not contain any highly volatile components, then the liquid phase can also be introduced without any disadvantage directly into the top space or gas space of the filling medium tank.

By means of the at least one sensor, which in the case of a filling system or a filling machine comprising a plurality of filling elements is preferably provided separately for each filling element or for each filling position formed thereby, reliable monitoring of the filling process and in particular also reliable detection of defective filling positions is possible. Defective filling positions are those at which the interior of the container in question is not sealed off from the surrounding environment at least during the filling phase due to the container being damaged and/or due to defective seals on the filling element. Initiated by the signal of the at least one sensor, the filling element of a defective filling position is closed and the container in question is ejected from the container stream after having left the filling machine.

Also in the method according to the invention, the setting of the nominal filling level preferably takes place using the trinox method. In this method, filling medium displaced from the container via the return gas tube, or trinox tube, together with gaseous and/or vaporous components or with the return gas, is fed back into the bottom of the liquid space of the filling medium tank after separation of the gaseous and/or vaporous components, and in particular, is introduced into the liquid space below the filling-medium level therein. As a result, filling medium that is fed back does not come into contact with the filling-medium level in the filling medium tank. This avoids disturbance of the filling medium therein by the filling medium that is fed back. The collection chamber is preferably connected to the gas space of the filling medium tank, but a calming of the flow of return gas (for example inert gas, for example $CO_2$ gas and/or nitrogen) takes place in the collection chamber so that also no disruption or substantially no disruption to the atmosphere in the gas space of the filling medium tank is caused by this return gas.

As used herein, a container bearing sealingly against the filling element means that the container in question bears with its container mouth pressed sealingly against the treatment head or against the filling element or against a seal thereon.

As used herein, "containers" include containers in the form of cans, bottles and also large-volume containers made in each case of metal, glass and/or plastic.

As used herein, "trinox compressed gas" is an inert gas, for example sterile air, nitrogen and/or $CO_2$ gas that, in order to set the nominal filling level, is fed to the top space of the respective container at a pressure that is greater than the filling pressure or the pressure in the gas space of the filling medium tank.

As used herein, the expression "substantially" or "around" means deviations of ±10%, preferably of ±5%, from the exact value in each case, and/or deviations in the form of changes that have no impact on function.

BRIEF DESCRIPTION OF THE DRAWINGS

These and other features of the invention will be apparent from the following detailed description and the accompanying drawings, in which.

DETAILED DESCRIPTION

Figure 1:
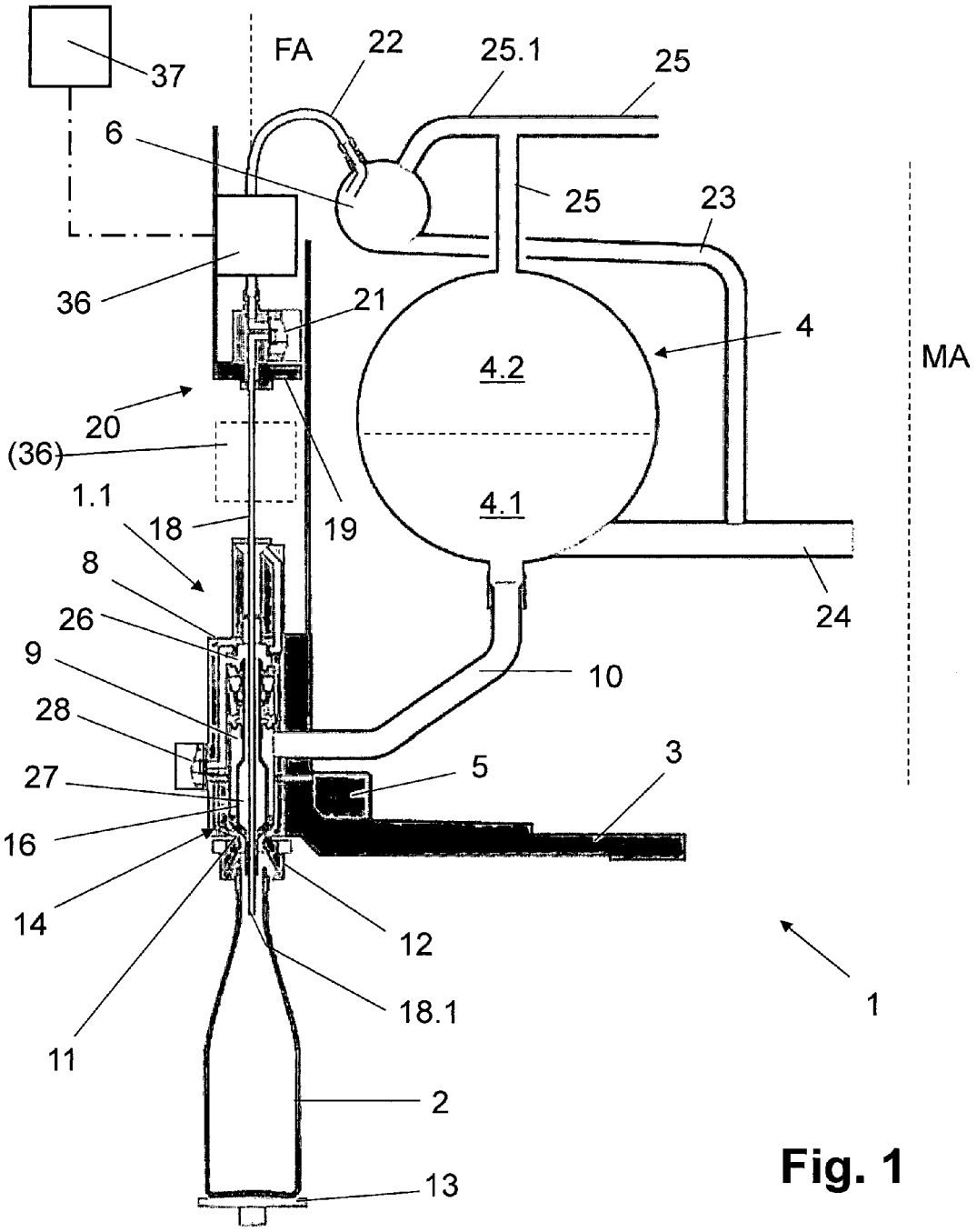
FIG. 1 shows a cross-section of a first embodiment a filling element of a filling system.

FIG. 1 shows a filling element 1.1 on the circumference of a rotor 3 of a rotary filling machine 1 for filling a container 2 with a liquid filling-medium. Typical containers include bottles. The rotor 3 rotates about a vertical machine axis MA.

A ring-shaped filling-medium tank 4 located on the rotor 3 serves all the filling elements 1.1. The tank 4 is partially filled with the liquid filling-medium to form a liquid space 4.1 and a gas space 4.2 located above the liquid space 4.1. In some embodiments, an inert gas fills the gas space 4.2. Examples of inert gas include $CO_2$ and nitrogen. Depending on the filling method, the gas space 4.2 is at positive pressure, normal pressure, or negative pressure.

Connected to the tank 4 is at least one collection chamber. In the illustrated embodiment, there are two such collection chambers. These collection chambers are implemented by a first ring-channel 5 located below the tank 4 and a second ring-channel 6 located above the tank 4, or at least above the filling-medium level in the tank 4. Like the tank 4, the first and second ring-channels 5, 6 are common to all the filling elements 1.1. The first and second ring-channels provide trinox gas to the filling elements at a pressure that is greater than that of the gas space 4.2. Examples of trinox gas include sterile air, $CO_2$ gas, and nitrogen.

The filling element 1.1 comprises a filling-element housing 8 that forms a liquid-carrying channel 9. This liquid-carrying channel extends from an upper region of the filling-element housing 8 to an underside of the filling-element housing 8. At the upper region of the filling-element housing 8, a product line 9 connects the liquid-carrying channel 9 to the liquid space 4.1. At the underside of the filling-element housing 8, the liquid-carrying channel 9 forms an annular discharge opening 11 that surrounds a filling-element axis FA.

During the filling process, a container carrier 13 lifts a container 2 so that its mouth presses tightly against a centering cone 12 that surrounds the discharge opening 11. This results in a seal between the container 2 and the filling element 1.1. A liquid-dispensing valve 14, which is disposed in the liquid-carrying channel 9, opens and closes to control flow of liquid filling-medium through this discharge opening 11 and into the container 2.

A first gas-tube 16 coaxial with the filling-element axis FA includes an expanded section upstream of the discharge opening 11. This expanded section functions as a valve body that cooperates with a valve face in the liquid-carrying channel 9 to form the liquid-dispensing valve 14. Axial movement of the first gas-tube 16 thus enables it to function as a valve tappet.

The first gas-tube 16 protrudes through the discharge opening 11 beyond the underside of the filling element 1.1 and thus extends into the top space of the container 2 during the filling process. A pneumatic actuating device acts on the first gas-tube 16 to open and close the liquid-dispensing valve 14 in a controlled manner.

The first gas-tube 16 surrounds a second gas tube 18. The second gas tube 18 is a trinox tube or a return gas tube that is open at both ends. Like the first gas-tube 16, the second gas tube 18 is coaxial with the filling-element axis FA. A gas channel 27 separates an inner wall of the first gas-tube 16 from an outer wall of the second gas-tube 18. The extent to which the second gas-tube 18 protrudes in the container 2 determines the filling level to which the container will be filled with filling medium. In particular, a lower open end 18.1 of the second gas-tube 18 is located at the desired filling level.

The second gas-tube 18 passes through the filling-element housing 8. An upper end of the second gas-tube 18 protrudes beyond the upper end of the filling-element housing 8. In the illustrated embodiment, a carrying ring of a displacement device 20 holds the second gas-tube 18, as well as second gas-tubes of other filling elements. This allows all second gas-tubes to be moved axially at the same time to set a filling level.

At its upper end, the second gas-tube 18 connects to an upper region of the second ring-channel 6 via a flexible line 22. A first control-valve 21 controls flow between the second ring-channel 6 and the second gas-tube 18.

In the embodiment shown in FIG. 1, a first line 23 connects a lower region of the second ring-channel 6 to a supply line 24 that supplies filling medium. This same supply line 24 provides filling medium to top up the level of filling medium in the tank 4.

A second line 25.1 connects an upper region of the second ring-channel 6 to a third line 25 that feeds inert gas into the gas space 4.2. The second ring-channel 6 thus forms a separator that receives an aerosol comprising liquid and gas from the container and allows it to separate into a liquid fraction and a gas fraction. Within the second ring-channel 6, the liquid fraction collects in a lower sub-space connected to the first line 23 and gas fraction collects in an upper sub-space that connects via the second line 25.1 and the third line 25 to the gas space 4.2 of the tank 4. As a result, the same pressure prevails in the second ring-channel 6 and in the tank 4.

The housing also defines a gas space 26 and a controlled gas duct that is controlled by a second control-valve 28. An upper end of the first gas-tube 16 or the gas channel 27 opens into the gas space 26. The controlled gas duct and the second control-valve 28 connect the gas channel 27 to the first ring-channel 5 in a controlled manner as will be described in greater detail below.

The filling element 1.1 can use any one of a variety of filling methods for filling a container 2. In all these methods, the second gas-tube 18 extends into a container that is sealed against the filling element 1.1 and controls the filling level in the container 2.

These filling methods all begin with opening the liquid-dispensing valve 14. When the second control-valve 28 is closed and the first control-valve 21 is open, inflowing liquid medium pushes gas from the container's interior through the second gas-tube 18, into the second ring-channel 6, and ultimately into the gas space 4.2 of the tank 4. Eventually, the rising level of filling medium submerges the lower tube end 18.1. This stops further gas flow through the second gas-tube 18. The liquid filling-medium in the second gas-tube 18 rises to a level that is below the level of the filling-medium level in the tank 4 but above the level of the filling-medium level in the container 2. Upon the lapse of an interval, the liquid-dispensing valve 14 closes.

With the first control-valve 21 still open, the second control-valve 28 also opens. This admits pressurized gas into the container's headspace. The pressurized gas comes from the first ring-channel 5 via the gas space 26 and the gas channel 27. This pressurized gas pushes further filling medium through the end 18.1 and into the second gas-tube 18. Some of this filling medium returns to the second ring-channel 6. As it does so, the headspace becomes larger and the filling level in the container 2 becomes lower.

Eventually, the filling level drops far enough for the end 18.1 to emerge from the filling medium. At this point, the filling level has been corrected and filling is complete. Consequently, the first and second control-valves 21, 28 are both closed. The filled container 2 can then be removed from the filling element 1.1 by lowering the container carrier 13.

What emerges from the second gas-tube 18 during the fill-level correction process is a mixture of gas and filling medium. The second ring-channel 6 separates these components. The liquid filling-medium is fed back via the first line 23 and the supply line 24 into the liquid space 4.1 of the tank 4. This liquid filling-medium contains essentially no gas. As a result, there is no agitation or disturbance, and in particular, no vortex formation, that would provoke release of volatile components from the filling medium.

Figure 2:
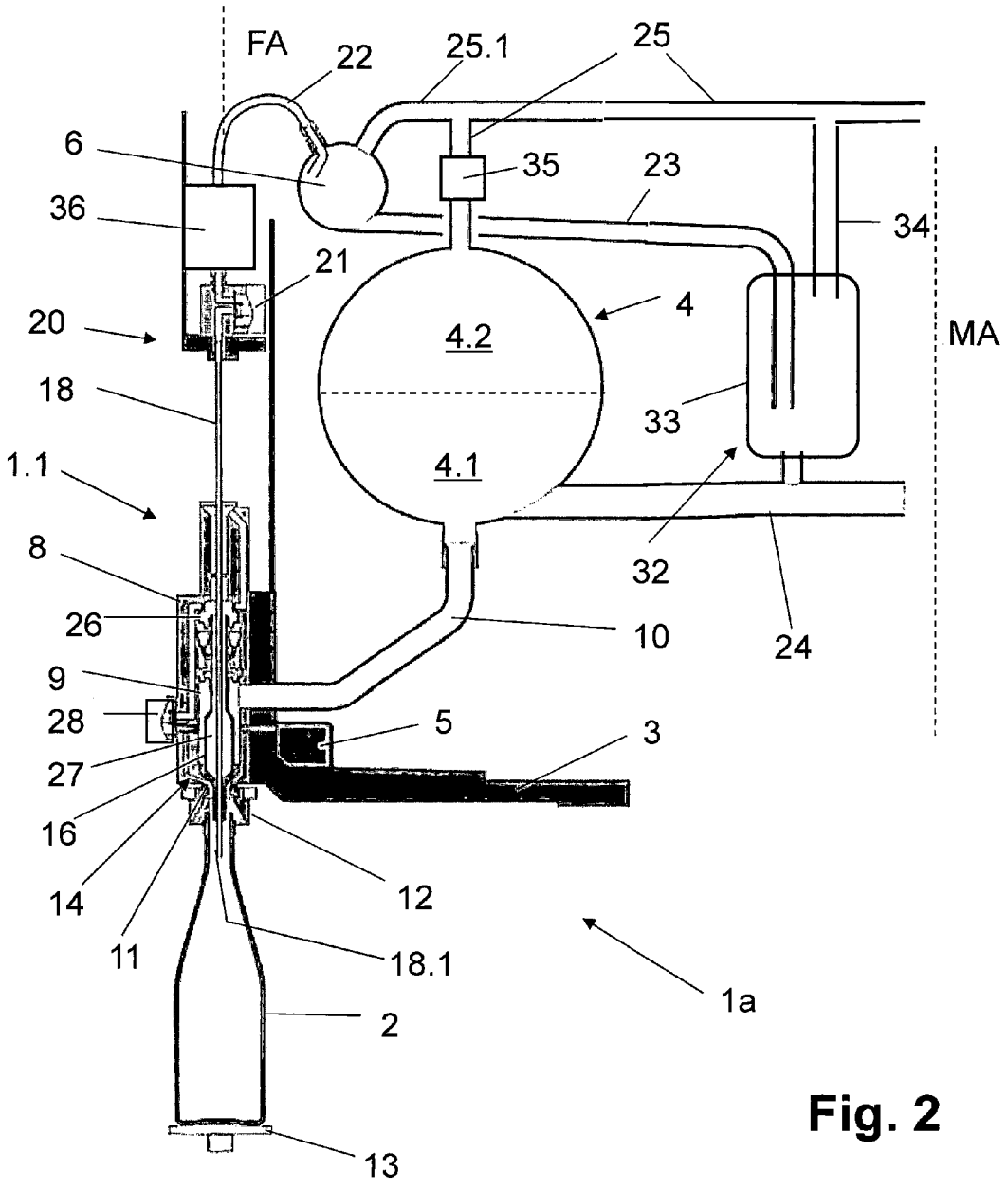
FIG. 2 shows a cross-section of a second embodiment a filling element of a filling system.

In a second embodiment, shown in FIG. 2, a filling system 1*a* that has a separate liquid separator 32 disposed between the first line 23 and the supply line 24. The liquid separator 23 includes a separator housing 33 that forms a closed housing interior. A top of this housing 33 receives the first line 23 and connects to a fourth line 34 that connects to the third line 25. A bottom of the separator housing 33 connects to the supply line 24. All of these connections are sealed.

The second embodiment of a filling system 1*a* also includes a shut-off valve 35 disposed along a connection between the gas space 4.2 and the third line 25. During normal filling, the shut-off valve 35 opens.

The liquid separator 32 promotes improved separation of gas that has been entrained or dissolved by the returning liquid filling-medium. As a result, filling medium that returns to the tank 4 through the separator 32 is substantially free of any gas that might stimulate vortex formation or bubbles within the tank 4.

The first and second embodiments of the filling system 1, 1*a* include a sensor 36 that is disposed along the path of gas returning to the second ring-channel 6 between the second gas-tube 18 and the flexible line 22. In some embodiments, as shown in by a dashed square in FIG. 1, the sensor 36 is arranged below the first control-valve 21 in the region of the second gas-tube 18.

The sensor 36 detects and monitors flow of matter into the second ring-channel 6 and sends a signal to an electronic control unit of the filling system 1, 1*a*. A suitable sensor 36 is an electrical sensor of the type used to control an engine, such as one that measures either volume rate of flow or mass rate of flow.

In some embodiments, the sensor 36 has no moving parts. An example of such a sensor is a magnetically inductive flow meter. In other embodiments, the sensor 36 functions as both a flow monitor and as a flow meter. In other embodiments, the sensor 36 is a pressure sensor.

A data line connects the sensor 36 to an evaluation unit 37. The evaluation unit 37 compares actual values with expected nominal values. A mismatch between the two, and in particular, detection of negligible return flow, implies a defect in either the seal or in the bottle. In that case, based on the result of such comparison, the evaluation unit 37 may trigger further processing steps, for example, ejecting a defective bottle or switching off a filling element. This avoids feeding damaged and/or inadequately filled containers for further processing.

In the case of a vacuum filling system, this also prevents external air from entering the return gas duct due to lack of proper sealing. In such cases, closing the liquid-dispensing valve 14 upon detection of a defect also prevents external air from being drawn into the tank 4 via a defective container 2 and/or via defective seals of the filling element 1.1. This external air would otherwise flow through the filling medium in the filling tank for the entire duration of the filling phase, creating a contamination risk for all filling elements, and not just for the filling element with the defective seal.

Another advantage of promptly closing off a defective filling element is to reduce considerable operating costs associated with operating a vacuum fan when there is a leak. Furthermore, without the monitoring and closing function achieved by the sensor 36, this fan would also have to be dimensioned with relatively high power, which then means increased investment costs. In the case of a filling medium containing alcohol, another disadvantage would also be increased alcohol losses.

The invention has been described above on the basis of examples of embodiments. It will be understood that numerous changes and modifications are possible without thereby departing from the inventive concept on which the invention is based.

Having described the invention, and a preferred embodiment thereof, what is claimed as new, and secured by Letters Patent is:

1. A method for filling containers with a liquid filling-medium supplied from a filling-medium tank, said method comprising sealing a container against a filling element, connecting an interior of said container to a flow duct within said filling element, wherein gas displaced from said container's interior is discharged as return gas through said flow duct, wherein filling medium displaced from the container's interior at the end of the filling process is channeled through said flow duct into a collection chamber that is separate from a filling-material tank, and wherein filling material that has been collected in said collection chamber is fed back into said filling-material tank, adding liquid filling-medium to said container, thereby causing gas to exit said container via said flow duct, using pressurized gas, removing liquid filling-medium from said container through said flow duct, guiding said removed liquid filling-medium to said collection chamber, and monitoring flow of matter that passes through said flow duct on its way to said collection chamber.

2. The method according to claim 1, further comprising causing liquid filling-medium to flow from said collection chamber to a liquid filling-medium tank that supplies liquid filling-medium to a plurality of filling elements.

3. The method according to claim 1, further comprising causing liquid filling-medium to flow from said collection chamber to a liquid-filled space of a liquid filling-medium tank that supplies liquid filling-medium to a plurality of filling elements.

4. The method of claim 1, wherein monitoring said flow comprises detecting a return gas flow that is below a nominal flow value, said method further comprising shutting down said filling element in response to detecting said flow.

5. The method of claim 1, wherein adding liquid filling-medium to said container comprises overfilling said container, said method further comprising causing excess liquid medium to climb out of said container through said flow duct and past a sensor for monitoring flow of matter that passes through said flow duct on its way to said collection chamber.

6. An apparatus comprising a filling system, said filling system comprising a tank, a liquid-filled space, a collection chamber that is separate from said tank, and a filling element, wherein said filling element comprises a liquid-guiding channel, a discharge opening, a liquid-dispensing valve, a sensor, and a flow duct, wherein said tank is partially-filled with said liquid filling-medium, wherein a level of said liquid filling-medium in said tank defines said liquid-filled space within said tank, wherein said liquid-guiding channel forms said discharge opening through which said medium flows into a container that is sealed against said filling element, wherein said liquid-dispensing valve controls flow of said medium into said container, wherein said liquid-guiding channel is connected to said liquid space, wherein, during operation, said flow duct connects to an interior of said container during a filling phase, wherein, in operation, gas displaced from said container's interior is discharged as return gas through said flow duct, return gas displaced from said container during filling flows through said flow duct and enters said collection chamber, and filling material that has been collected in said collection chamber is fed back into said tank, and wherein said sensor monitors flow of matter through said flow duct.

7. The apparatus of claim 6, further comprising a return-gas tube that, in operation, extends into said container and enables matter from said container to be guided out of said container and into said collection chamber following overfilling of said container past a nominal fill level.

8. The apparatus of claim 6, wherein said collection chamber is configured to separate said matter into a liquid fraction and a gas fraction, said apparatus further comprising a connection between said collection chamber and said liquid space through which said liquid fraction is returned to said tank.

* * * * *